United States Patent [19]

Peterson

[11] 3,939,612

[45] Feb. 24, 1976

[54] REINFORCED GRINDING WHEEL

[75] Inventor: George N. Peterson, Grafton, Mass.

[73] Assignee: Dresser Industries, Inc., Dallas, Tex.

[22] Filed: June 2, 1971

[21] Appl. No.: 149,145

[52] U.S. Cl. ..... 51/293; 51/206 NF; 51/298 R; 51/308

[51] Int. Cl.[2] ..... B24D 5/04; B24D 7/02

[58] Field of Search ..... 51/309, 298, 295, 293, 51/206 NF

[56] References Cited

UNITED STATES PATENTS

| | | | |
|---|---|---|---|
| 2,010,475 | 8/1935 | Bowen | 51/297 |
| 3,146,560 | 9/1964 | Hurst | 51/293 |
| 3,208,838 | 9/1965 | Fischer et al. | 51/293 |
| 3,262,230 | 7/1966 | Seymour et al. | 51/293 |
| 3,262,231 | 7/1966 | Polch | 51/293 |
| 3,529,945 | 9/1970 | Charvat | 51/298 |
| 3,615,304 | 10/1971 | Caserta | 51/293 |

*Primary Examiner*—Donald J. Arnold
*Attorney, Agent, or Firm*—Raymond T. Majesko; John N. Hazlewood

[57] ABSTRACT

The disclosure illustrates a grinding wheel that is reinforced by a length of wire positioned on the side faces of the wheel in a spiral pattern beginning adjacent the inner diameter with successive turns progressively radially outward alongside the wheel. The wire is bonded to the wheel by an epoxy resin.

7 Claims, 4 Drawing Figures

INVENTOR.
GEORGE N. PETERSON
BY Charles M. Hogan
Gary M. Brown
ATTORNEYS.

REINFORCED GRINDING WHEEL

The present invention relates to grinding wheels and more particularly to reinforced grinding wheels.

In order to provide a more efficient cutting process the cutting speeds of grinding wheels have been increased in recent years. These increases in speed in some cases create a centrifugal force field on the grinding wheel material that exceeds its inherent capacity to resist. This problem is particularly evident in those types of grinding wheels having a relatively large inner diameter. In this type of wheel a substantial stress concentration is built up near this inner diameter.

In the past it has been proposed to reinforce the inner diameter by cementing a steel ring to the sides of the grinding wheel adjacent the inner diameter. While this approach is generally quite effective in reinforcing the wheel, it does not conform to the irregularities of the wheel. In addition, it results in quite a bit of scrap material during its manufacture, i.e., the scrap resulting from the formation of the hole for the inner diameter of the wheel.

Therefore it is an object of the present invention to efficiently and economically reinforce a grinding wheel of the above general type.

These ends are achieved by a reinforced grinding wheel which has a length of wire positioned on at least one of the side faces of the wheel in a spiral pattern beginning adjacent the inner diameter. Successive turns of the wire substantially abut one another and are positioned progressively radially outward with respect to the side face of the wheel. The wires are bonded to the side wall of the wheel so that the wheel is reinforced. The above and other related objects and features of the present invention will be apparent from a reading of the description of the disclosure shown in the accompanying drawing and the novelty thereof pointed out in the appended claims.

Figure 4:
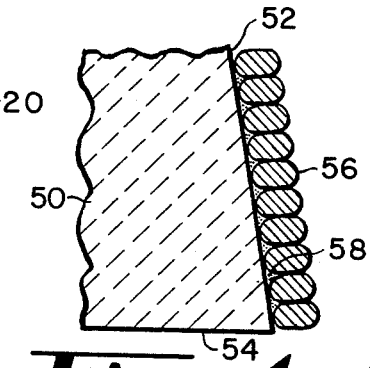
Figure 3:
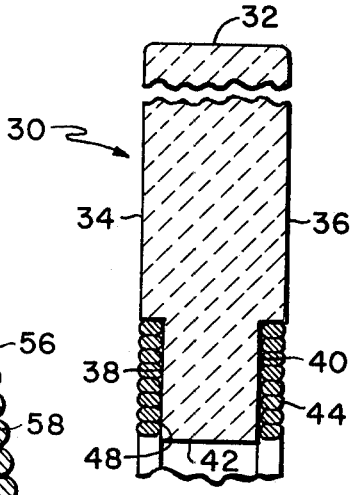

FIG. 3 is a cross-sectional view of a reinforced grinding wheel employing a different embodiment of the present invention; and FIG. 4 is a fragmentary cross-sectional view of a reinforced grinding wheel showing still another embodiment of the present invention. A length of wire 20 is positioned on the side faces 14 and 16 of wheel 10 in a spiral pattern. The spiral pattern begins adjacent the inner diameter 18 and the successive turns of the spiral pattern substantially abut one another and are positioned progressively radially outward with respect to the side faces 14 and 16 of wheel 10. The radial extent of the spiral pattern of wire may be varied to suit the particular reinforcing requirements of the wheel, as is apparent to those skilled in the art. The wire 20 may be suitably fastened at 22 where the length of wire begins at the inner diameter 18 and at 24 where the wire ends at the outer periphery of the pattern of wire. In addition, adjacent turns may be fastened at suitable locations in the spiral pattern to facilitate handling.

The wire is bonded to the wheel by a suitable adhesive 26. Preferably the adhesive is a reinforced epoxy adhesive that cures at room temperature. An example of such an adhesive would be a resin known as Epotuf 37-140 with a hardener known as Epotuf 37-164 and the resin would be reinforced with Wollastonite. The Epotuf compounds are avaiable from Reichhold Chemicals, Inc., Azusa, Calif.

Figure 2:
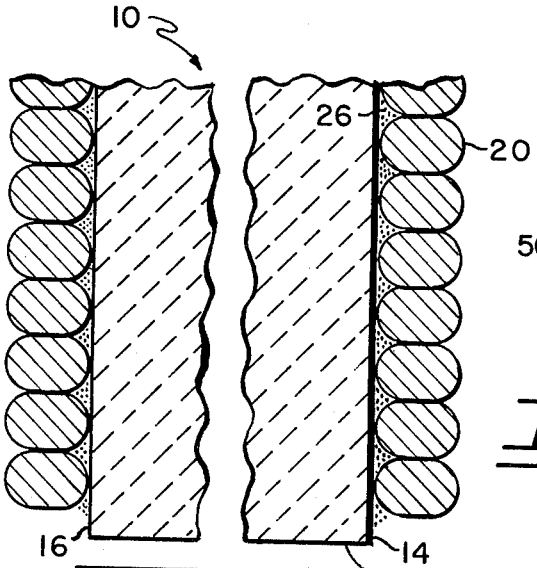
FIG. 2 is a greatly enlarged fragmentary view of the grinding wheel of FIG. 1 taken on lines 2—2 of FIG. 1.

Preferably the wire is formed from steel wire having a circular cross section that is rolled to produce an elongated generally oval section, as shown particularly in FIG. 2. This type of arrangement enables substantial contact between the adjacent turns of the spiral and, in addition, produces a greatly increased bonding area between the surface of the wheel and the wire. As can be seen in FIG. 2, the curved sides of the wire 20 abut the side faces 16 and 14 of the wheel to produce annular recesses that provide a much greater contact area for the adhesive 26 than would be produced, for example, with a flat plate. The wire 20 may be formed from a low carbon steel wire that is rolled to produce the generally oval shape. An example of a typical forming operation would be 16 gauge round wire with a diameter of 0.0625 inches rolled to a thickness of 0.040 inches. The cold working during the rolling operation produces an increase in the tensile strength of wire thereby enhancing its ability to reinforce the wheel.

Figure 1:
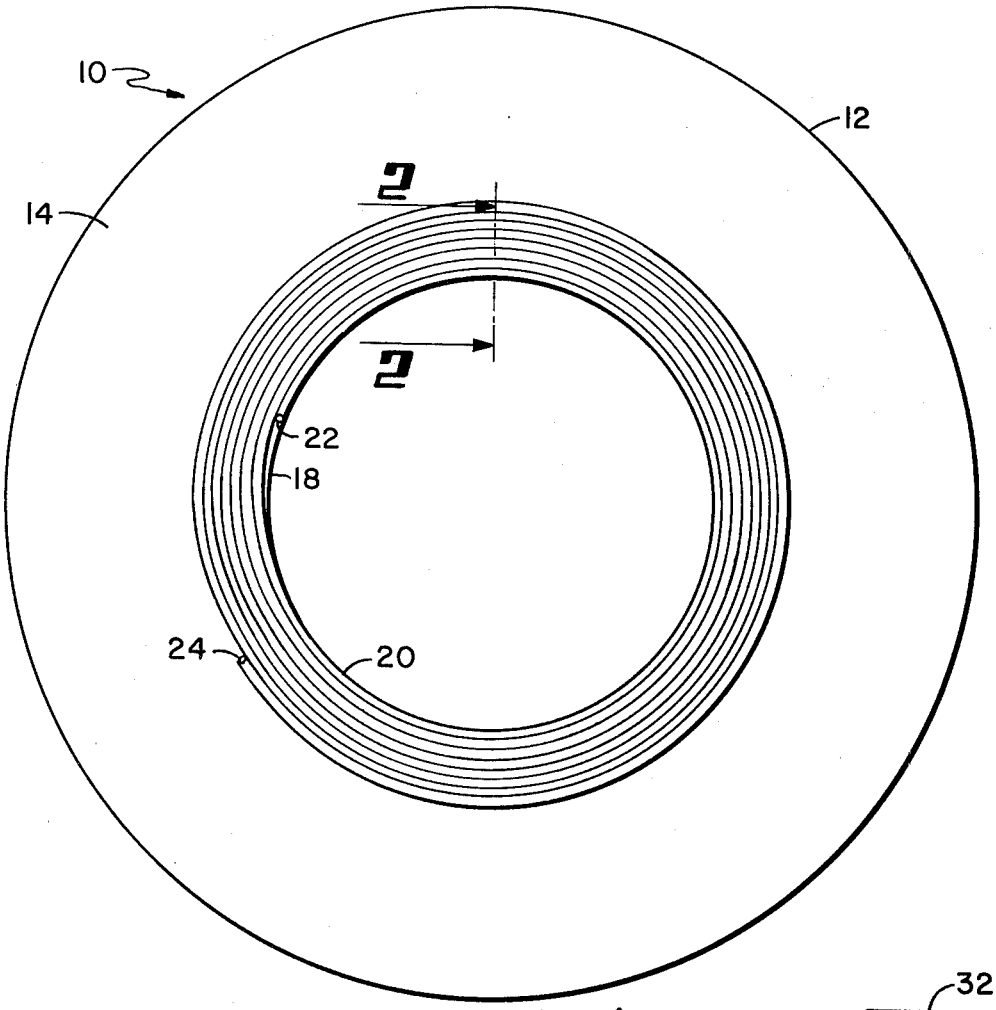
FIG. 1 is a side view of a reinforced grinding wheel embodying the present invention.

From some applications the thickness of the grinding wheel cannot be increased because of limitations on mounting apparatus. For this application the embodiment of FIG. 3 is utilized. A grinding wheel 30 having a peripheral grinding surface 32 has side faces 34 and 36. Side faces 34 and 36 have generally annular recesses 38 adn 40 extending from an inner hole 42 in the wheel 30. Lengths of wires 44 are positioned in the recesses 38 and 40 in a spiral pattern substantially similar to the wire of the embodiment shown in FIG. 1. The wires are bonded to the wheel by a suitable adhesive 48 to reinforce the inner diameter.

The flattened wire can be used to effectively reinforce grinding wheels with tapered side faces, as shown in FIG. 4. A grinding wheel 50 has tapered side faces 52 extending from an inner diameter 54. A length of flattened wire 56 is positioned on the side face 52 in a spiral pattern substantially similar to the wire of the embodiment shown in FIG. 1. A suitable adhesive 58 bonds the wire 56 to the side face 52.

It should be noted that the turns of flattened wire can be displaced laterally relative to one another and still provide an effective support. It should be apparent to those skilled in the art that the degree of taper of the side face with which the wire can effectively be used is a function of the wire thickness and width.

The above general arrangements provide a highly effective reinforcement of the inner diameter of a grinding wheel. Since the turns of the wire generally simply abut one another during assembly, they can more readily conform to surface irregularities of the grinding wheel, or to a tapered side face, than a flat steel plate. However, once the turns of the wire have been bonded to each other and to the side face of the wheel, they provide a very effective reinforcement of the wheel. It should be noted that the spiral pattern of wire is formed by a given length of wire and that there is substantially no waste compared to the stamping out of a steel ring. This greatly minimizes the cost of manufacturing the spiral wire.

The above arrangements, while much less expensive to produce, enable a much greater reinforcement of the wheel than for a steel plate of the same weight. The reason for this is that the spiral wire arrangement has a greater circumferential strength than an equal weight steel ring due to the higher inherent tensile strength of the wire. In addition, the increased bonding area enables a much greater area over which the tensile forces are transferred between the wheel and the wire. The arrangement of FIG. 3, while producing no increase in the thickness of the wheel, has almost the strength of the arrangement of FIGS. 1 and 2 in which the wire is placed on the face of the wheel. This is because the adhesive bonds the wire to the entire surface area of the recesses and enables an efficient transfer of stresses.

While the preferred embodiment of the present invention has been described above, it should be apparent that other modifications may be employed by those skilled in the art without departing from the spirit and scope of the present invention.

What is claimed as novel and desired to be secured by Letters Patent of the United States is:

1. A reinforced grinding wheel comprising:

an abrasive grinding wheel having an inner diameter and a pair of side faces;

a length of wire positioned on at least one of the side faces of said wheel in a spiral pattern beginning adjacent the inner diameter and having successive turns substantially abutting one another and positioned progressively radially outward with respect to the side face of said wheel; and means for bonding the wire to the side wall of the wheel whereby the wheel is reinforced.

2. A reinforced grinding wheel as in claim 1 wherein said wire is formed from circular cross-section wire rolled to an elongated oval shape having the elongations in an axial direction relative to the side face of said wheel.

3. A reinforced grinding wheel as in claim 1 wherein said wire is positioned on both of the side faces of said wheel.

4. A reinforced grinding wheel as in claim 3 wherein said abrasive grinding wheel has an annular recess adjacent the inner diameter and said wire is positioned in said recess.

5. A reinforced grinding wheel as in claim 1 wherein said bonding means comprises a room temperature curing epoxy adhesive.

6. A reinforced grinding wheel as in claim 1 wherein said side faces are tapered.

7. A reinforced grinding wheel as in claim 6 wherein said wire has a generally elongated oval cross-sectional shape with the elongations extending in an axial direction.

* * * * *